US005552080A

United States Patent [19]

Bolmer

[11] Patent Number: 5,552,080

[45] Date of Patent: Sep. 3, 1996

[54] COLD CLEANING SOLVENTS

[75] Inventor: Michael S. Bolmer, Lower Providence, Pa.

[73] Assignee: Elf Atochem North America, Inc., Philadelphia, Pa.

[21] Appl. No.: 540,679

[22] Filed: Oct. 11, 1995

Related U.S. Application Data

[63] Continuation-in-part of Ser. No. 378,430, Jan. 26, 1995, abandoned, which is a continuation-in-part of Ser. No. 198,455, Feb. 18, 1994, abandoned, which is a continuation-in-part of Ser. No. 185,567, Jan. 24, 1994, abandoned, which is a continuation-in-part of Ser. No. 48,090, Apr. 15, 1993, abandoned.

[51] Int. Cl.[6] ..... C11D 7/30; C11D 7/50; C23G 5/032

[52] U.S. Cl. ..... 510/412; 134/40; 252/364; 510/273

[58] Field of Search ..... 252/162, 170, 252/171, 364; 8/142; 134/38, 40, 42

[56] References Cited

U.S. PATENT DOCUMENTS

| | | | |
|---|---|---|---|
| 3,671,442 | 6/1972 | Schofield et al. | 252/171 |
| 3,984,364 | 10/1976 | Tarb | 260/22 R |
| 4,378,968 | 4/1983 | Peignier et al. | 8/142 |
| 4,836,947 | 6/1989 | Lund et al. | 252/171 |
| 4,842,764 | 6/1989 | Lund et al. | 252/171 |
| 5,070,113 | 12/1991 | Omure et al. | 521/131 |
| 5,085,797 | 2/1992 | Swan et al. | 252/171 |
| 5,126,067 | 6/1992 | Swan et al. | 252/171 |
| 5,137,651 | 8/1992 | Stachura et al. | 252/171 |
| 5,271,775 | 12/1993 | Asano et al. | 134/40 |
| 5,278,196 | 1/1994 | Robin et al. | 521/98 |
| 5,447,646 | 9/1995 | Chisolm et al. | 252/67 |

FOREIGN PATENT DOCUMENTS

| | | | |
|---|---|---|---|
| 325365 | 7/1989 | European Pat. Off. . | |
| 1-132814 | 5/1989 | Japan . | |
| 1-132787 | 5/1989 | Japan | 252/171 |
| 1-132785 | 5/1989 | Japan | 252/171 |
| 1-139780 | 6/1989 | Japan . | |
| 1-204999 | 8/1989 | Japan . | |
| 2-200788 | 8/1990 | Japan . | |
| 2-203000 | 8/1990 | Japan | 252/171 |
| 2-202598 | 8/1990 | Japan | 252/171 |
| 3-31224 | 2/1991 | Japan . | |
| 3-252500 | 11/1991 | Japan . | |
| 2232673 | 12/1990 | United Kingdom . | |

*Primary Examiner*—Linda Skaling Therkorn
*Attorney, Agent, or Firm*—Stanley A. Marcus; William D. Mitchell

[57] ABSTRACT

Nonazeotropic solvent blends useful for cold cleaning applications in an open environment containing an HCFC, HFC or PFC component having no flash point (such as 141b), a higher boiling nonflammable chlorinated solvent (such as perchloroethylene), and a moderately flammable, intermediate boiling, oxygenated organic solvent (such as n-butanol).

5 Claims, No Drawings

COLD CLEANING SOLVENTS

CROSS-REFERENCE TO RELATED APPLICATIONS

This application is a continuation-in-part of copending application Ser. No. 08/378,430, filed Jan. 26, 1995 (now abandoned), which in turn is a continuation-in-part of application Ser. No. 08/198,455, filed Feb. 18, 1994 (now abandoned), which in turn is a continuation-in-part of application Ser. No. 08/185,567, filed Jan. 24, 1994 (now abandoned), which in turn is a continuation-in-part of application Ser. No. 08/048,090, filed Apr. 15, 1993 (now abandoned).

FIELD OF THE INVENTION

This invention relates to nonazeotropic solvent blends useful for cold cleaning applications which blends have reduced ozone depletion potential ("ODP") and acceptable evaporation rates and which, when allowed to evaporate, result in vapor and liquid fractions each having no flash point, especially to solvent blends containing a low boiling hydrochlorofluorocarbon ("HCFC"), hydrofluorocarbon ("HFC") or perfluorocarbon ("PFC") having no flash point, a higher boiling nonflammable chlorinated solvent, and an intermediate boiling, moderately flammable, oxygenated organic solvent.

Cold cleaning applications include such operations as degreasing, defluxing, and precision cleaning wherein the solvent is typically applied to the soiled part by aerosol or by wiping with rags or similar objects soaked in the solvent and then allowed to air dry, that is, to applications wherein the solvent is applied to the soiled part in an open environment. In particular, this invention is intended for such applications wherein it is important to avoid the use of flammable materials because of their proximity to possible ignition sources.

Examples of these evaporative cold cleaning applications occur in automotive, airplane, or marine maintenance procedures, where all ignition sources can not be removed. Other applications include industrial processes that involve hot equipment, such as spinneret cleaning or degreasing of hot rolled steel.

The solvent must not fractionate into either a flammable vapor or a flammable liquid upon evaporation, because these uses involve evaporating the solvent completely after each use. It is also important that the solvent does not evaporate too fast, such that the solvent does not have time to carry the soil away from the part to be cleaned, or that it does not evaporate too slowly, such that the part can not be further processed without waiting for the solvent to dry. It is also important that the concentration of chlorinated solvent be kept to a minimum to avoid possible health problems.

BACKGROUND OF THE INVENTION 1,1,2-Trichloro-1,2,2-trifluoroethane ("113") and 1,1,1-trichloroethane ("140a") are used as cleaning solvents in applications where they are applied to the part to be cleaned and allowed to evaporate. As these solvents are suspected of depleting the ozone layer, it is desirable, when cleaning in an open environment, to find an alternative solvent with a lower ODP, preferably below 0.1. Some cleaning applications can be served by aqueous cleaners, but they are slow to evaporate and can cause corrosion if not completely removed. Hydrocarbons, alcohols, or other organic solvents can be used for cleaning and will evaporate at a practical rate, but they are flammable and can not be used for many cleaning applications performed in an open environment. Thus, 113 and 140a are the only available nonflammable cleaning solvents with an acceptable evaporation rate (that is, as noted above, a rate slow enough for the solvent to have time to clean and drain off the part to be cleaned, but fast enough so that in an open environment work is not delayed by waiting for the solvent to evaporate).

Pure chlorinated solvents such as perchloroethylene ("PCE") or trichloroethylene ("TCE") are too toxic for such evaporative cold cleaning applications performed in an open environment.

Pure 1,1-dichloro-1-fluoroethane ("141b") is a good solvent, but it is not suitable for the evaporative cleaning applications of this invention because of its low boiling point (31° C.) and large heat of vaporization. The low boiling point causes the 141b to evaporate very quickly in an open environment such that it will evaporate before it can carry the soil off the part to be cleaned. This, combined with the high heat of vaporization, causes cooling of the part to be cleaned, so that water can freeze out of the atmosphere, causing frost to form on the part. When the frost melts, it leaves water, which can cause corrosion on metal parts, or interfere with following uses of the cleaned part. Thus, it is desirable to find a cleaner which will leave the part clean and dry.

Several patents have been published recently on azeotropic or near azeotropic solvent blends of 141b and alcohols, such as EPC Application 325,365 and U.S. Pat. Nos. 4,836,947 and 4,842,764, but these patents do not disclose the use of a third, nonflammable, component to ensure that upon evaporation neither the vapor nor the liquid fractions will have a flash point. ("Flash point" is measured by ASTM method D56 and is the temperature, if any, at which a flame passed over a cup of liquid will ignite the vapors so that the flame spreads down and outward. 141b is an example of a compound with no flash point.) Further, such azeotropic blends have over about 90% 141b and a boiling point below that of 141b, so that they suffer from the same deficiencies as pure 141b.

Combinations of 141b with chlorinated solvents (or alcohols) such as PCE have also been disclosed (as in Japanese Patent 1-132814). While chlorinated solvents such as PCE and TCE can be used to somewhat lower the concentration of 141b, a manufacturer of these solvents (Dow) recommends limiting their use to levels of no more than about 25% because of their toxicity.

STATEMENT OF THE INVENTION

This invention relates to nonazeotropic solvents blends useful for evaporative cold cleaning applications in an open environment which blends have from about 10 to about 60 weight % of an HCFC, HFC, or PFC halocarbon component which has 2–4 carbon atoms, a boiling point of about 25°–45° C., and no flash point (such as 141b); from about 1 to about 30 weight % of a nonflammable chlorinated solvent component with a boiling point of about 80°–130° C. (such as PCE or TCE); and from 10 to about 40 weight % of an oxygenated organic solvent component which has at least 3 carbon atoms, moderate flammability (a flash point above 0° C.) and a boiling point intermediate that of the other two components (such as n-butanol or isopropanol), said components and their proportions being chosen such that the blend has an average vapor pressure of from about 2 psia to about 7.6 psia (so that it will have an acceptable evaporation rate) and a substantially lower ODP than 113 or 140a, and such that when the blend is evaporated the resultant vapor and liquid fractions each have no flash point.

DETAILED DESCRIPTION OF THE INVENTION

This invention deals with the discovery that certain solvent blends have reduced ODP and acceptable evaporation rates (i.e., have an average vapor pressure of about 2–7.6 psia) for evaporative, cold cleaning applications in an open environment, and, when evaporated, result in vapor fractions and liquid fractions each of which have no flash point. Pure 141b has a vapor pressure of about 11.4 psia, while blends of 75 weight % 141b with 25 weight % of TCE or PCE have a calculated average vapor pressure of 9.3, which result in unacceptably fast evaporation rates.

The low boiling halocarbon component generally has a boiling point of from about 25° C. to about 45° C., preferably 30°–40° C. Preferred halocarbons are 141b and 1,1,2,3,3-pentafluoropropane ("245 ea", boiling point of 39° C.), particularly 141b. This component preferably constitutes about 35–50% of the blend, for non-aerosol applications and about 50–60% for aerosol applications (on a propellant-free basis), since higher percentages result in unacceptably fast evaporation rates.

The high boiling, nonflammable chlorinated solvent component generally has a boiling point of from about 80° C. to about 130° C., preferably 87°–121° C. Preferred chlorinated solvents are TCE (boiling point of 87° C.), PCE (boiling point of 121° C.), and mixtures thereof, particularly PCE. TCE and PCE each have no flash point. This component preferably constitutes about 20–25% of the blend for non-aerosol applications and about 20–30% for aerosol applications (on a propellant-free basis), higher amounts not being recommended for health reasons.

Examples of the moderately flammable (flash point over 0° C.), intermediate boiling, oxygenated organic solvent component are isopropanol, isopropyl acetate, dimethyl carbonate, n-propanol, 2-butanol, ethyl propionate, n-propyl acetate, methylpropylketone, diethylketone, n-butyl formate, isobutanol, n-butanol, and mixtures thereof, preferably n-butanol or isopropanol, most preferably n-butanol. This component preferably constitutes about 25–40% of the blend for non-aerosol applications and from 10 to about 20% for aerosol applications (on a propellant-free basis) since aerosols bum more easily than pools of liquids.

The three components and their proportions are chosen such that the blend (and its vapor and liquid fractions upon evaporation) meets the foregoing criteria in terms of flash point, ODP, and vapor pressure.

Two most preferred blends of the invention for non-aerosol applications consist of 50% 141b; 25% PCE; and 25% n-butanol or isopropanol (particularly n-butanol). Each of these blends have no flash point (tested by ASTM method D56). A preferred blend for aerosol applications contains 56% 141b; 25% PCE; 15% n-butanol; and 4% carbon dioxide, equivalent to about 58% 141b; 26% PCE; and 16% n-butanol on a propellant-free basis, this blend having no flame extension when sprayed through a flame.

Examples of other preferred blends include (a) 35–50% 141b or 245 ea, 20–25% PCE or TCE, and 25–40% ethanol, isopropanol, or methanol; and (b) 35–50% 141b or 245 ea, 20–25% PCE, and 25–40% 2-butanol, n-butanol, n-butyl formate, diethylketone, dimethyl carbonate, ethyl propionate, isobutanol, isopropyl acetate, methylpropylketone, n-propanol, or n-propyl acetate.

The blends of this invention are useful in a variety of evaporative cold cleaning operations as noted above which are performed in an open environment. Application of the blend to an object to be cleaned (such as a brake pad) may be made in any manner well known to the art such as by dipping, spraying (such as by use of an aerosol spray), or wiping, followed by air drying to allow the solvent to evaporate. The treated pans are found to be clean and dry.

What is claimed is:

1. A nonazeotropic solvent blend useful for cold cleaning applications in an open environment consisting essentially of about 10–60 weight % of a halocarbon component selected from 1,1-dichloro-1-fluoroethane and 1,1,2,3,3-pentafluoropropane; about 1–30 weight % of a nonflammable chlorinated solvent component with a boiling point of about 80°–130° C. selected from the group consisting of perchloroethylene, trichloroethylene, and mixtures thereof; and from 10 to about 40 weight % of an oxygenated organic solvent component having at least 3 carbons, a flash point over 0° C. and a boiling point intermediate that of the other two components, said components and their proportions being chosen such that (a) the blend has an average vapor pressure of about 2–7.6 psia and a substantially lower ozone depletion potential than 1,1,2-trichloro-1,2,2-trifluoroethane or 1,1,1-trichloroethane, and (b) when the blend is allowed to evaporate the resultant vapor fractions and liquid fractions each have no flash point.

2. A nonazeotropic solvent blend as in claim 1 wherein the halocarbon component is 1,1-dichloro-1-fluoroethane.

3. A nonazeotropic solvent blend as in claim 1 which consists essentially of about 35–50 weight % 1,1-dichloro-1-fluoroethane or 1,1,2,3,3-pentafluoropropane; about 20–25 weight % perchloroethylene; and about 25–40 weight % of n-butanol, 2-butanol, dimethyl carbonate, isobutanol, isopropanol, or n-propanol.

4. A nonazeotropic solvent blend as in claim 1 for use in aerosols which consists essentially of about 50–60 weight % 1,1-dichloro-1-fluoroethane; about 20–30 weight % perchloroethylene; and about 10–20 weight % n-butanol.

5. A nonazeotropic solvent blend which consists essentially of about 50 weight % 1,1-difluoro-1-fluoroethane; about 25 weight % perchloroethylene; and about 25 weight % n-butanol.

* * * * *